US010309357B2

(12) United States Patent
Filippi et al.

(10) Patent No.: US 10,309,357 B2
(45) Date of Patent: Jun. 4, 2019

(54) FLUID INJECTOR

(71) Applicant: CONTINENTAL AUTOMOTIVE GMBH, Hannover (DE)

(72) Inventors: Stefano Filippi, Castel Anselmo Collessalvetti (IT); Mauro Grandi, Leghorn (IT); Francesco Lenzi, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 49 days.

(21) Appl. No.: 15/021,785

(22) PCT Filed: Aug. 27, 2014

(86) PCT No.: PCT/EP2014/068202
§ 371 (c)(1),
(2) Date: Mar. 14, 2016

(87) PCT Pub. No.: WO2015/036244
PCT Pub. Date: Mar. 19, 2015

(65) Prior Publication Data

US 2016/0230724 A1 Aug. 11, 2016

(30) Foreign Application Priority Data

Sep. 13, 2013 (EP) ..... 13184401

(51) Int. Cl.
*F02M 51/06* (2006.01)
*F02M 61/16* (2006.01)

(52) U.S. Cl.
CPC .... *F02M 51/0682* (2013.01); *F02M 51/0614* (2013.01); *F02M 51/0685* (2013.01);
(Continued)

(58) Field of Classification Search
CPC ..... F02M 51/0682; F02M 51/0685; F02M 51/0621; F02M 2200/9061; F02M 51/166; F02M 51/0614
(Continued)

(56) References Cited

U.S. PATENT DOCUMENTS 4,127,835 A * 11/1978 Knutson ..... H01F 7/1615 310/30
4,313,571 A 2/1982 Bellicardi et al.
(Continued)

FOREIGN PATENT DOCUMENTS

CN 102383994 A 3/2012
EP 1088986 A1 4/2001
(Continued)

OTHER PUBLICATIONS

Magnetic Susceptibilities of Paramagnetic and Diamagnetic Materials at 20°C., Georgia State University, Mar. 15, 2009; http://web.archive.org/web/20090315121617/http://hyperphysics.phy-astr.gsu.edu/hbase/Tables/magprop.html.*

*Primary Examiner* — Alexander M Valvis
(74) *Attorney, Agent, or Firm* — Laurence A. Greenberg; Werner H. Stemer; Ralph E. Locher

(57) ABSTRACT

A fluid injector for a combustion engine has a tubular body which hydraulically connects a fluid inlet end of the injector to a fluid outlet end of the injector. A magnetic core is affixed inside the body, a solenoid is disposed on the outside of the body, and an axially moveable armature is disposed inside the body. A valve assembly controls an axial flow of fluid through the body. The valve assembly has a valve needle to be operated by the armature and a sleeve of diamagnetic material which is located radially between the armature and the body.

5 Claims, 3 Drawing Sheets

(52) U.S. Cl.
CPC ..... *F02M 61/166* (2013.01); *F02M 2200/02* (2013.01); *F02M 2200/08* (2013.01); *F02M 2200/90* (2013.01)

(58) Field of Classification Search
USPC ..... 335/304, 229, 266, 296
See application file for complete search history.

(56) References Cited

U.S. PATENT DOCUMENTS

| | | | | |
|---|---|---|---|---|
| 4,637,554 | A * | 1/1987 | Takeda | F02M 51/065 239/585.3 |
| 5,207,387 | A * | 5/1993 | Bergstrom | F02M 51/0614 239/585.4 |
| 5,769,391 | A | 6/1998 | Noller et al. | |
| 6,012,655 | A * | 1/2000 | Maier | F02M 51/0614 239/533.3 |
| 6,687,997 | B2 | 2/2004 | Dallmeyer et al. | |
| 7,070,128 | B2 | 7/2006 | Delas | |
| 7,093,362 | B2 * | 8/2006 | Dallmeyer | F02M 51/005 239/585.4 |
| 7,407,119 | B2 * | 8/2008 | Czimmek | F02M 51/0614 239/585.1 |
| 7,909,270 | B2 * | 3/2011 | Bertini | F02M 51/0675 239/533.11 |
| 2003/0189112 | A1 | 10/2003 | Fukutomi et al. | |
| 2003/0189183 | A1 * | 10/2003 | Noller | F02M 51/0614 251/129.21 |
| 2005/0258283 | A1 | 11/2005 | Czimmek | |
| 2009/0144982 | A1 * | 6/2009 | Miller | B05B 1/302 29/890.12 |
| 2009/0179090 | A1 | 7/2009 | Reiter | |
| 2011/0057059 | A1 | 3/2011 | Yamamoto et al. | |

FOREIGN PATENT DOCUMENTS

| | | | |
|---|---|---|---|
| EP | 1245828 | A1 | 10/2002 |
| EP | 2436909 | A1 | 4/2012 |
| JP | 2004232597 | A | 8/2004 |
| KR | 20000067818 | A | 11/2000 |
| KR | 20040029046 | A | 4/2004 |
| KR | 100878131 | B1 | 1/2009 |
| RU | 119818 | U1 | 8/2012 |
| WO | 9303272 | A1 | 2/1993 |

* cited by examiner

FLUID INJECTOR

BACKGROUND OF THE INVENTION

Field of the Invention

Present disclosure relates to a fluid injector which is in particular operable to inject fuel into a combustion engine, especially in a motor vehicle.

A fuel injector for injecting fuel into a combustion engine comprises a valve assembly for controlling a flow of fuel into the engine and an actuator for operating the valve assembly. The actuator is of the solenoid type and comprises a coil that is wound around a longitudinal axis of the injector and an armature that is axially movable with respect to the coil. When the coil is energized by an electrical current, a magnetic field is generated that moves the armature in an axial direction. In response to the movement, the valve assembly opens and permits a predetermined flow of fuel into the engine.

Due to imperfections of the magnetic field, the force exerted onto the armature is not purely axial but may also have a radial component. The radial force may push the armature against an encasement where friction is generated. Among the disadvantages that come with such friction are an early wear, an increase of the time the valve assembly is opened, lowered injection repeatability, a lowered maximum operative pressure, a spray instability or static and dynamic flow shift over lifetime.

To overcome these problems, narrow tolerances may be used to prevent a radial movement of the armature. Alternatively, a radial air gap between armature and encasement may be introduced to reduce the fluctuations of the magnetic force. However, narrow tolerances may lead to high production cost and the radial air gap may not be sufficient to stabilize the armature, especially when the engine is coming through heavy vibrations as may be experienced under normal operating conditions. In addition, the air gap will lose its effect once the armature is moved by a certain amount in a radial direction.

U.S. Pat. No. 4,313,571 A shows an electromagnetically actuated injector for an internal combustion engine. A diamagnetic material is used between adjacent elements of the actuator as a ware-resistant material.

BRIEF SUMMARY OF THE INVENTION

It is an object of present invention to provide an injector with reduced radial forces onto the axially movable armature of an actuator of the solenoid type. This object is achieved by a fluid injector having the features of the independent claim. Advantageous embodiments and developments of the fluid injector are specified in the dependent claims, in the following description and in the figures.

According to the invention, a fuel injector for a combustion engine comprises a tubular body. The tubular body in particular hydraulically connects a fluid inlet end of the injector to a fluid outlet end of the injector. For example, the tubular body is a valve body of the injector.

The fuel injector further comprises a magnetic core affixed inside the body. In particular, the magnetic core is affixed to the tubular body by means of a friction-fit connection with the tubular body.

In addition, the fuel injector comprises a solenoid on the outside of the tubular body. The solenoid may comprise a bobbin around which the turns of the solenoid are wound. Additionally, an axially moveable armature is arranged inside the tubular body.

The fuel injector has a valve assembly for controlling a fluid flow, in particular an axial flow, of fuel through the tubular body and comprising a valve needle. The valve needle is configured to be operated by the armature. It interacts in particular with a valve seat at the fluid outlet end of the fluid injector to control the fluid flow. The valve seat is preferably comprised by the tubular body or by a seat element which is inserted into an opening of the tubular body at the fluid outlet end.

Further, the fuel injector comprises a sleeve of diamagnetic material. The sleeve is located radially between the armature and the body. Preferably, the sleeve and the armature overlap axially.

A diamagnetic material has the property to create a magnetic field in opposition to an externally applied magnetic field. Mounted in a radial direction of the armature, the diamagnetic sleeve may reduce the radial forces of the magnetic field created by the solenoid. This way, the armature may move more freely in an axial direction, i.e. friction and/or wear may be particularly small. This way, the injector may have an increased lifetime, production cost may be lowered as allowable tolerances may be increased, the repeatability of the opening and closing characteristics of the valve assembly may be increased, the flow spray stability may be improved, the injector may be operated at a higher fuel pressure, and/or static and dynamic flow shift over lifetime may be reduced.

In contrast to other means for centering the armature, the diamagnetic sleeve will create an increasing force biasing the armature away from the tubular body, the closer the armature comes to the body. Therefore, a stable equilibrium is created where the armature is particularly well centred in the middle of the sleeve.

Preferably, the mass and magnetic susceptibility of the sleeve are chosen such that the radial forces on the armature cancel out—or at least essentially cancel out—when the solenoid is energized. That is, the sleeve is dimensioned such that its capacity to create a magnetic field in opposition to an externally applied magnetic field is just as large as or even larger than a radial component of the magnetic field created by the solenoid. This way, radial forces may be truly cancelled out.

In a preferred embodiment, the valve needle comprises an armature retainer that extends into a corresponding cavity of the core for axially guiding the valve needle. Due to the diamagnetic space ring centering the armature, the radial force transferred to the valve needle by the armature are particularly small. Thus, with advantage, the wear and/or friction in the region of the armature retainer are particularly small.

The material of the armature retainer may be chosen such that it glides freely on the surface of the core. Magnetic or electrical considerations may not be necessary. The bearing of the valve needle inside the injector may thus be precise and smooth.

In one embodiment, the valve needle extends axially through the armature, in particular through a central opening of the armature. The armature may be axially displaceable with respect to the valve needle and mechanically coupled to the valve needle by means of the armature retainer. The central opening is in particular dimensioned in such fashion that the valve needle is operable to axially guide the armature. By using the armature retainer and the cavity of the magnetic core as lateral guide, the armature need not have physical contact to the sleeve or the body.

The armature retainer may be shaped such that it permits a predetermined tilting of the armature with respect to the core. This may prevent a hyperstatic bearing of the core. It may also permit a certain degree of radial movement of the armature towards or away from a section of the sleeve. As mentioned, the amount of force acting between the sleeve and the armature is dependent on the distance between the two. By permitting a certain degree of tilting it may be easier for the armature to find its radial position of force equilibrium.

In one embodiment, the diamagnetic sleeve is affixed to the inner radial surface of the body. For example, the diamagnetic material is applied to the inner radial surface for forming the sleeve. In this case, the tubular body, the sleeve and the armature are preferably dimensioned in such fashion that there is an annular gap between the diamagnetic sleeve and the armature. The annular gap may be an air gap and serve to stabilize the armature. Also, the gap may enable a radial movement of the armature with respect to the sleeve. The term "air gap" in particular refers to the injector without the fluid which it dispenses in operation. In operation of the injector, the annular gap is in particular filled with the fluid.

In an alternative embodiment, the diamagnetic sleeve may be affixed to the outer radial surface of the armature. For example, the diamagnetic material is applied to the outer radial surface for forming the sleeve. In this case, the tubular body, the sleeve and the armature are preferably dimensioned in such fashion that there is an annular gap between the diamagnetic sleeve and the body.

In one embodiment, the sleeve comprises or consist of at least one diamagnetic material selected from the following group: bismuth, pyrolytic graphites, perovskite copper-oxides, alkali-metal tungstenates, vandanates, molybdates, titanate niobates, $NaWO_3$, $YBa_2Cu_3O_7$, $TiBa_2Cu_3O_3$, $Al_xGa_1As$ and Cr, Fe selenides.

In one embodiment, the sleeve comprises a polymer having the diamagnetic material suspended therein. This way, characteristics of the sleeve may be designed specifically to the present requirements.

In one embodiment, the valve needle is in the shape of a tube which extends axially through the armature, the tube being configured to conduct the fluid.

BRIEF DESCRIPTION OF THE SEVERAL VIEWS OF THE DRAWING

An exemplary embodiment of the fluid injector will now be described in more detail with reference to the figures, in which.

DESCRIPTION OF THE INVENTION

Figure 1:
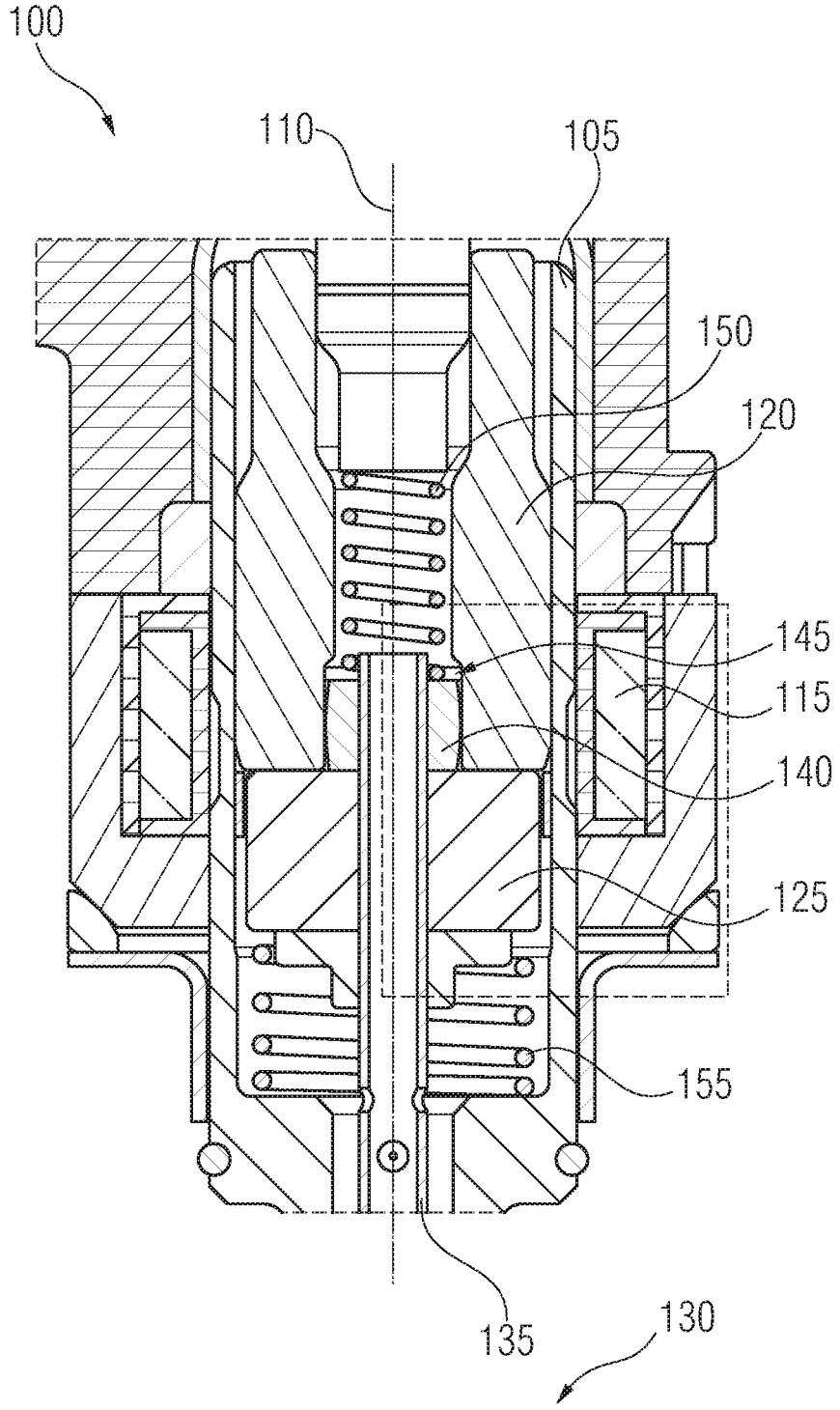
FIG. 1 shows a longitudinal section view of a portion of a fluid injector according to an embodiment.

FIG. 1 shows a longitudinal section of a fluid injector according to an embodiment of the invention. The fluid injector is configured for controlling a flow of fuel into an internal combustion engine, especially a piston engine for use in a motor vehicle. In other words, the fluid injector of the present embodiment is a fuel injector 100 for an internal combustion engine. It is in particular provided for dosing fuel directly into the combustion chamber of the internal combustion engine.

The fuel injector 100 comprises a tubular body 105 that extends along a longitudinal axis 110 for hydraulically connecting a fluid inlet end of the injector 100 to a fluid outlet end of the injector.

The fuel injector 100 comprises an actuator assembly comprising a coil which is in particular in the shape of a solenoid 115, a magnetic core 120 and a moveable armature 125. The solenoid 115 is arranged radially subsequent to the tubular body 105 on the outside of the tubular body 105. The solenoid generally comprises a number of turns wound around the longitudinal axis 110. The solenoid 115 may be affixed to the outside of the body 105. The magnetic core 120 is arranged inside the body 105 so that it faces the solenoid 115. The core 120 is magnetic—i.e. in particular it is made from a magnetic material such as a ferromagnetic material, for example from a ferritic steel—and, thus, may help channelling or controlling the magnetic field which is generated when the solenoid 115 is energized by supplying an electrical current that flows through the turns of the solenoid 115. The armature is arranged inside the tubular body 105 axially adjacent to the magnetic core 120 and in particular downstream of the magnetic core 120. The armature 125 is axially displaceable in reciprocating fashion along the longitudinal axis 110 with respect to the tubular body 105 and the magnetic core 120 which is positionally fix with respect to the latter. The armature 125 is also made of a magnetic material such as a ferritic steel so that it will be attracted by the magnetic core 120 when the solenoid 115 creates a magnetic field.

The fuel injector further comprises a valve assembly 130. The valve assembly 130 comprises a valve needle 135. Expediently, it further comprises a valve seat (not shown in the figures) which cooperates with the valve needle to prevent fluid flow from the fluid injector in a closing position of the valve needle 135 and enables dispensing of fluid from the fluid injector through one or more injection holes in further positions of the valve needle. Such a valve assembly is also useful for any other embodiment of the fluid injector.

The armature 125 is connected to a valve assembly 130 via the valve needle 135. In particular, the armature 125 is mechanically coupled to the valve needle so that it is operable to displace the valve needle 135 away from the closing position. It is preferred that the valve needle 135 is hollow such as to permit a flow of fuel parallel to the longitudinal axis 110 towards the valve assembly 130. The valve needle 135 may especially include a tube that runs axially through the armature 125.

In the present exemplary embodiment, the armature 125 is axially displaceable with respect to the valve needle 135. Relative axial displacement of the armature 125 and the valve needle 135 is limited by an armature retainer 140 which is comprised by the valve needle 135. The armature retainer 140 may be fixed to the tubular shaft of the valve needle 135 as in the present embodiment. Alternatively, the armature retainer 140 may be in one piece with the shaft of the valve needle. By means of interaction with the armature retainer 140, the armature 125 is operable to take the valve needle 135 with it when moving in axial direction towards the magnetic core 120.

The armature retainer 140 extends into a corresponding cavity 145 of the magnetic core 120 in the present embodiment. The member 140 will be discussed in more detail below with respect to FIG. 2.

It is furthermore preferred that a first elastic member 150 is configured to press the valve needle 135 in a direction away from the core 120, which is in particular equivalent with an axial direction towards the valve seat. In other words, the first elastic member 150 is configured to bias the valve needle 135 towards the closing position. By means of mechanical interaction via the armature retainer 140, the armature 125 is also biased in axial direction away from the magnetic core 120 by the first elastic member 150. Thus, the armature 125 may move away from the core 120 when the solenoid 115 is not energized. In one embodiment, a second elastic member 155 exerts an opposing force from the opposite side of armature 125 to force the armature against the armature retainer 140 and/or to decelerate a movement of the armature with respect to the valve needle 135 in direction away from the magnetic core 120.

The injector 100 may be configured for a fuel flow that starts in an upper part of FIG. 1 and extends along the longitudinal axis 110 into the core 120, through the first elastic member 150, into the valve needle 135 and to the valve assembly 130. From there, the fuel may be injected into a combustion engine when a current flows through the solenoid 115, so that the armature 125 is moved up axially against the core 120, thereby opening the valve assembly 130 through a valve needle 135.

Figure 2:
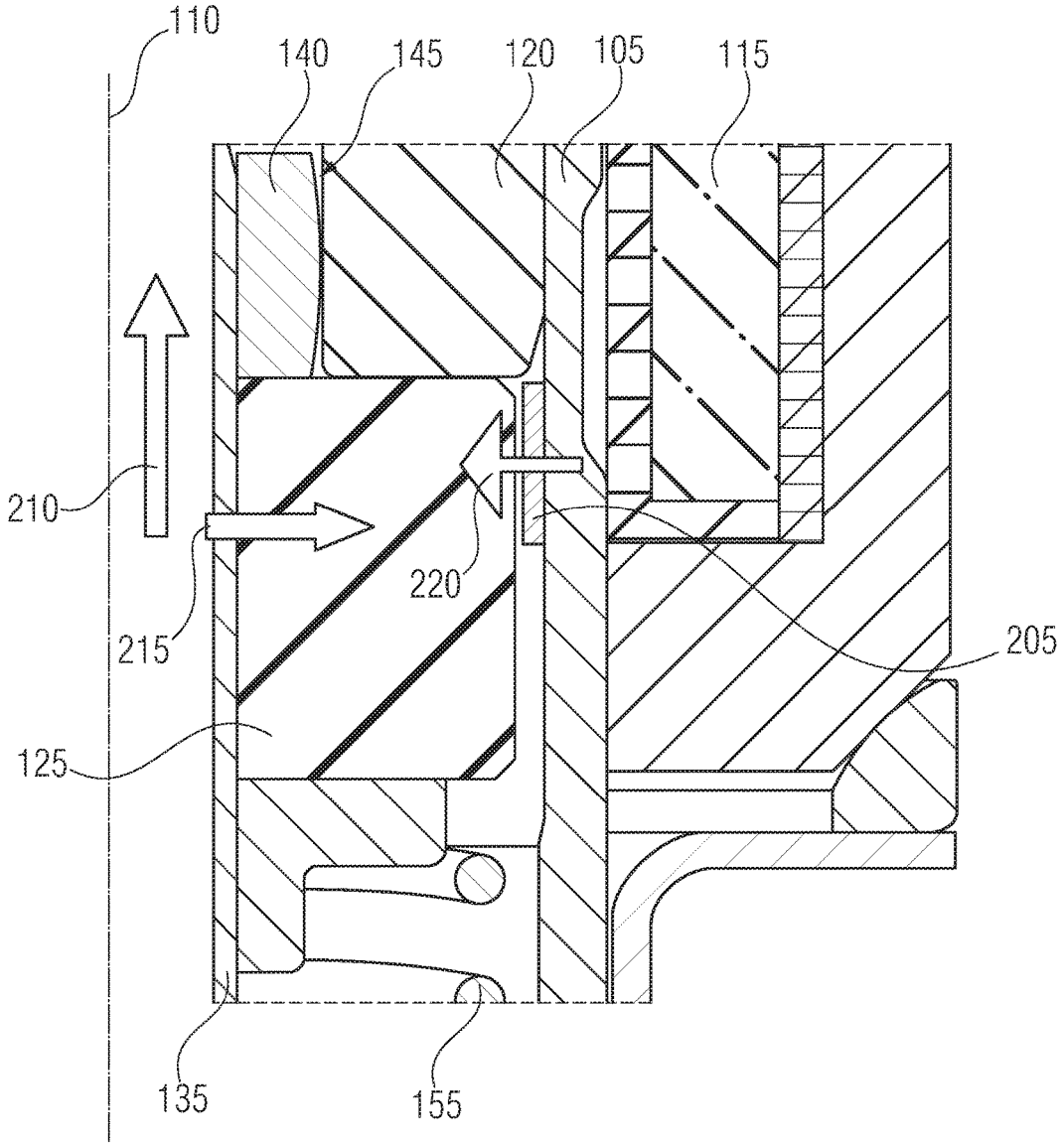
FIG. 2 shows a magnification of a part of the fluid injector of FIG. 1.

A rectangle with broken line shows an area of FIG. 1 that is presented magnified in FIG. 2.

In an upper area of FIG. 2 it can be seen that the armature retainer 140 fits snugly in the cavity 145 of core 120. In this way, the armature retainer 140 cooperates with the magnetic core 120 to guide the valve needle 135 axially. The tube of the valve needle 135—which extends through a central opening in the armature 125—may in turn cooperate mechanically with the armature 125 for axially guiding the armature 125.

It is preferred that friction between the member 140 and the core 120 is low. Materials, especially of member 140, may be chosen accordingly. It is furthermore preferred that a radially outer surface of member 140 is spaced from the cavity 145 so that a certain degree of tilting between the valve needle 135—and consequently the armature 125—and the core 120 may take place.

A sleeve 205 is mounted radially between the tubular body 105 and the armature 125. Preferably, the sleeve 205 extends at least partly into the area of the solenoid 115. In other words, the sleeve 205 or a portion of the sleeve 205 may be circumferentially enclosed by the solenoid 115. The sleeve 205 comprises or consists of a diamagnetic material, the diamagnetic material being for example selected from the group consisting of bismuth, pyrolytic graphites, perovskite copper-oxides, alkali-metal tungstenates, vandanates, molybdates, titanate niobates, $NaWO_3$, $YBa_2Cu_3O_7$, $TiBa_2Cu_3O_3$, $Al_xGa_1As$ and Cr, Fe selenides. The sleeve 205 may also comprise a polymer having a diamagnetic material as one of those mentioned above suspended therein.

The diamagnetic sleeve 205 per definition has a magnetic susceptibility that is negative. In reaction to an external magnetic field, the diamagnetic material of sleeve 205 generates another magnetic field of opposite direction. As the sleeve 205 is disposed laterally to the armature 125, i.e. it extends circumferentially around the armature 125, it may help to reduce or cancel out a radial portion of the magnetic field generated by the solenoid 115 in the region of the armature 125.

When the solenoid 115 is energized, its magnetic field generates an axial force 210 which pulls the armature 125 along longitudinal axis 110 towards the magnetic core 120 which sometimes is also denoted as a "pole piece". However, a portion of the magnetic field may induce a first radial force 215. The radial force may act in a radial direction which may not be predictable at the time of assembling the injector and may vary from injection event to injection event, and therefore may be hard to balance. Thus, wear and/or friction may be caused in conventional injectors by this radial force.

However, in case of the injector 100 according to the present embodiment, the same radial component of the magnetic field passes through the sleeve 205 in which an opposing magnetic field is created, exerting a second radial force 220 onto the armature 125 in opposite radial direction. Ideally, the radial forces 215 and 220 cancel themselves out.

Figure 3:
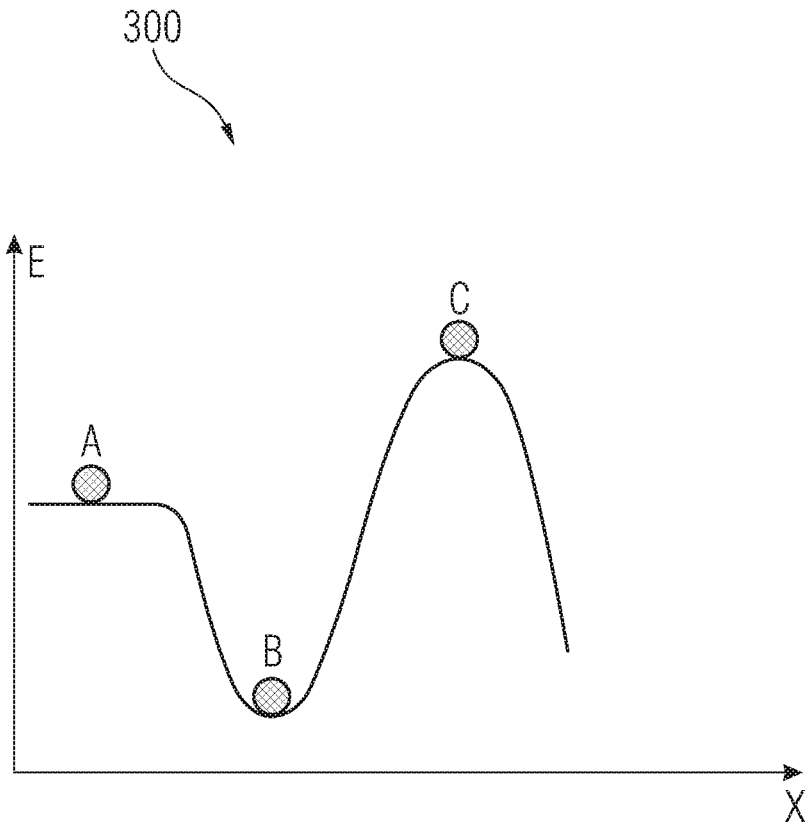
FIG. 3 shows a schematic diagram of energy levels of the armatures of different fluid injectors.

FIG. 3 shows a schematic diagram 300 of energy levels of the armatures 125 of different fuel injectors. In a horizontal direction, a displacement of armature 125 in a radial direction x is displayed. In a vertical direction, energy E of the armature 125 is shown. The higher the energy of armature 125 is, the stronger a residual force onto armature 125 in a radial direction may be.

A first point C symbolizes the conditions in a standard injector in which no further means are taken for radial stabilization of the armature 125. It can be seen that the armature 125 is in an unstable equilibrium state. A small displacement may lead to effective forces that increase the displacement.

A second point A shows circumstances on a conventional injector 100 with radial air gap. For small radial displacements of armature 125 the energy level remains constant. However, if the armature 125 is moved in a positive x-direction far enough, the movement is increased. Point A represents an indifferent equilibrium state.

In contrast, point B represents a stable equilibrium state. This represents the configuration of the injector 100 discussed above with respect to FIGS. 1 and 2. Through the use of diamagnetic sleeve 205, both a positive and a negative displacement of armature 125 in a radial direction will lead to an increasing counterforce that moves it back onto longitudinal axis 110. Thus, the radial position of armature 125 is kept stable.

The invention claimed is:

1. A fluid injector for injecting fuel into a combustion engine, the fluid injector comprising:

a tubular body hydraulically connecting a fluid inlet end of the injector to a fluid outlet end of the injector;

a magnetic core affixed inside said body;

a solenoid disposed on an outside of said body;

an armature inside said body and mounted for axial movement;

a valve assembly for controlling an axial flow of fluid through said body, said valve assembly including a valve needle configured to be operated by said armature;

said valve needle including an armature retainer formed for extending into a corresponding cavity formed in said magnetic core and for axially guiding said valve needle;

said valve needle extending axially through said armature and said armature retainer being shaped for permitting a predetermined tilting of said valve needle with respect to said magnetic core; and a sleeve of diamagnetic material disposed radially between said armature and said body, said sleeve being affixed to an inner radial surface of said tubular body and said tubular body, said sleeve and said armature being dimensioned for forming an annular gap between said sleeve and said armature, said sleeve having a mass and a magnetic susceptibility selected for substantially cancelling out radial forces on said armature with radial forces from said sleeve when said solenoid is energized;

said armature and said sleeve overlapping axially and said sleeve being operable for generating an increasing force biasing said armature away from said tubular body the closer said armature comes to said tubular body.

2. The injector according to claim 1, wherein said annular gap is a fluid-filled gap.

3. The injector according to claim 1, wherein said sleeve comprises a polymer having a diamagnetic material suspended therein.

4. The injector according to claim 1, wherein said valve needle is a tube extending axially through said armature for conducting the fluid.

5. A fluid injector for injecting fuel into a combustion engine, the fluid injector comprising:

a tubular body hydraulically connecting a fluid inlet end of the injector to a fluid outlet end of the injector;

a magnetic core affixed inside said body;

a solenoid disposed on an outside of said body;

an armature inside said body and mounted for axial movement;

a valve assembly for controlling an axial flow of fluid through said body, said valve assembly including a valve needle configured to be operated by said armature;

said valve needle including an armature retainer formed for extending into a corresponding cavity formed in said magnetic core and for axially guiding said valve needle;

said valve needle extending axially through said armature and said armature retainer being shaped for permitting a predetermined tilting of said armature with respect to said magnetic core; and a sleeve of diamagnetic material disposed radially between said armature and said body, said sleeve being affixed to an inner radial surface of said tubular body and said tubular body, said sleeve and said armature being dimensioned for forming an annular gap between said sleeve and said armature, said sleeve having a mass and a magnetic susceptibility selected for substantially cancelling out radial forces on said armature with radial forces from said sleeve when said solenoid is energized;

said armature and said sleeve overlapping axially and said sleeve being operable for generating an increasing force biasing said armature away from said tubular body the closer said armature comes to said tubular body.

* * * * *